US005143460A

United States Patent [19]

Wang

[11] Patent Number: 5,143,460

[45] Date of Patent: * Sep. 1, 1992

[54] PORTABLE HUMIDIFIER

[75] Inventor: Jui-Shang Wang, Taipei, Taiwan

[73] Assignee: Duracraft Corporation, Sudbury, Mass.

[ * ] Notice: The portion of the term of this patent subsequent to Nov. 19, 2008 has been disclaimed.

[21] Appl. No.: 747,514

[22] Filed: Aug. 20, 1991

Related U.S. Application Data

[63] Continuation-in-part of Ser. No. 487,315, Mar. 2, 1990, abandoned.

[51] Int. Cl.[5] ..... F24F 3/14; H05B 3/78

[52] U.S. Cl. ..... 392/405; 392/403; 392/406; 200/81.9 R

[58] Field of Search ..... 392/401, 403, 405, 406, 392/407, 394, 271, 272, 273, 275; 200/48 C, 81.9 R, 81.9 M

[56] References Cited

U.S. PATENT DOCUMENTS 2,810,167 10/1957 Parks ..... 392/405
3,085,145 4/1963 Wray, Jr. ..... 392/405
3,723,707 3/1973 Wunderlin ..... 392/406
3,892,945 7/1975 Lerner ..... 392/405
4,752,423 6/1988 Wong ..... 392/406
4,810,854 3/1989 Jursich et al. ..... 392/406
5,014,338 5/1991 Glucksman ..... 392/405
5,067,169 11/1991 Chiu ..... 392/406

*Primary Examiner*—Bruce A. Reynolds
*Assistant Examiner*—Tuan Vinh To
*Attorney, Agent, or Firm*—John E. Toupal; Harold G. Jarcho

[57] ABSTRACT

A humidifier including a base defining a boiler cavity; a liquid supply supported on the base and having a discharge opening communicating with the boiler cavity and adapted to maintain a given level of liquid therein; an evaporation unit removably mounted on the base and including an electrically energized heater element projecting into the cavity and adapted to induce evaporation of liquid contained thereby, and a vapor passage defining having a receiving end communicating with the cavity so as to receive vapor therefrom and a discharge end for discharging the vapor received from the cavity; and an electrical supply for supplying electrical.

23 Claims, 4 Drawing Sheets

PORTABLE HUMIDIFIER

CROSS-REFERENCE TO RELATED APPLICATION

This application is a continuation-in-part of U.S. patent application Ser. No. 07/487,315, entitled "Portable Humidifier", filed Mar. 2, 1990, now abandoned.

BACKGROUND OF THE INVENTION

This invention relates generally to humidifiers and, more specifically, to portable humidifiers intended for domestic use.

Various types of products are used to increase the humidity in the home environment. With respect to portable humidifying appliances, they may be broken down broadly into two categories, one being the evaporation type and the other being the steam vaporizer type. Evaporation type humidifiers typically utilize belts, pumps, slingers or the like to increase the rate of evaporation of the water from the liquid to the vapor state. Steam vaporizers generally are used to achieve very high humidification levels. Also known are humidifiers which use ultrasonic means to atomize water and thereby increase humidity.

Examples of various prior art steam vaporizers are disclosed in U.S. Pat. Nos. 2,369,623; 2,804,870; 2,810,167; 3,152,240; 3,723,707; 4,604,246 and 4,810,854. All of these patents are characterized by disclosing steam type humidification means in which there is a reservoir or water supply of some type which supplies water in controlled amounts to a boiler or heating means which is intended to convert the water into a steam vapor.

There are many problems involved with the prior art steam vaporizers. For example, the mineral deposits left by boiled water is difficult to clean and often causes deterioration of heater elements.

The object of this invention, therefore, is to provide an improved portable humidifier for use in domestic applications.

SUMMARY OF THE INVENTION

The invention is a humidifier including a base defining a boiler cavity; a liquid supply supported on the base and having a discharge opening communicating with the boiler cavity and adapted to maintain a given level of liquid therein; an evaporation unit removably mounted on the base and including an electrically energized heater element projecting into the cavity and adapted to induce evaporation of liquid contained thereby, and a vapor passage defining means having a receiving end communicating with the cavity so as to receive vapor therefrom and a discharge end for discharging the vapor received from the cavity; and an electrical supply for supplying electrical energy to the heater element. Removal of the evaporation unit from the base readily exposes the boiler cavity thereby facilitating cleaning thereof.

According to one feature of the invention, the evaporation unit further includes air passages having an entrance for receiving air from the environment and an exit communicating with the vapor passage, and a blower for inducing air flow into the entrance and out of the exit into the vapor passage. The mounting of the blower in the evaporation unit facilitates its removal during cleaning of the boiler cavity.

According to another feature of the invention, the liquid supply is a tank removably mounted on the base. Removal of the tank further facilitates cleaning of the base and cavity.

According to yet another feature of the invention, the base defines a reservoir including the cavity and a liquid supply channel having an inlet end and an outlet end communicating with the cavity, and the discharge opening of the supply tank communicates with the inlet end of the channel so as to supply liquid therethrough to the cavity. This arrangement simplifies both fabrication and cleaning of the base.

According to still another feature, the humidifier includes an enclosure mounted on the evaporation unit and enclosing the heating element. The enclosure isolates a volume of water in the boiler cavity to enhance evaporation efficiency.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
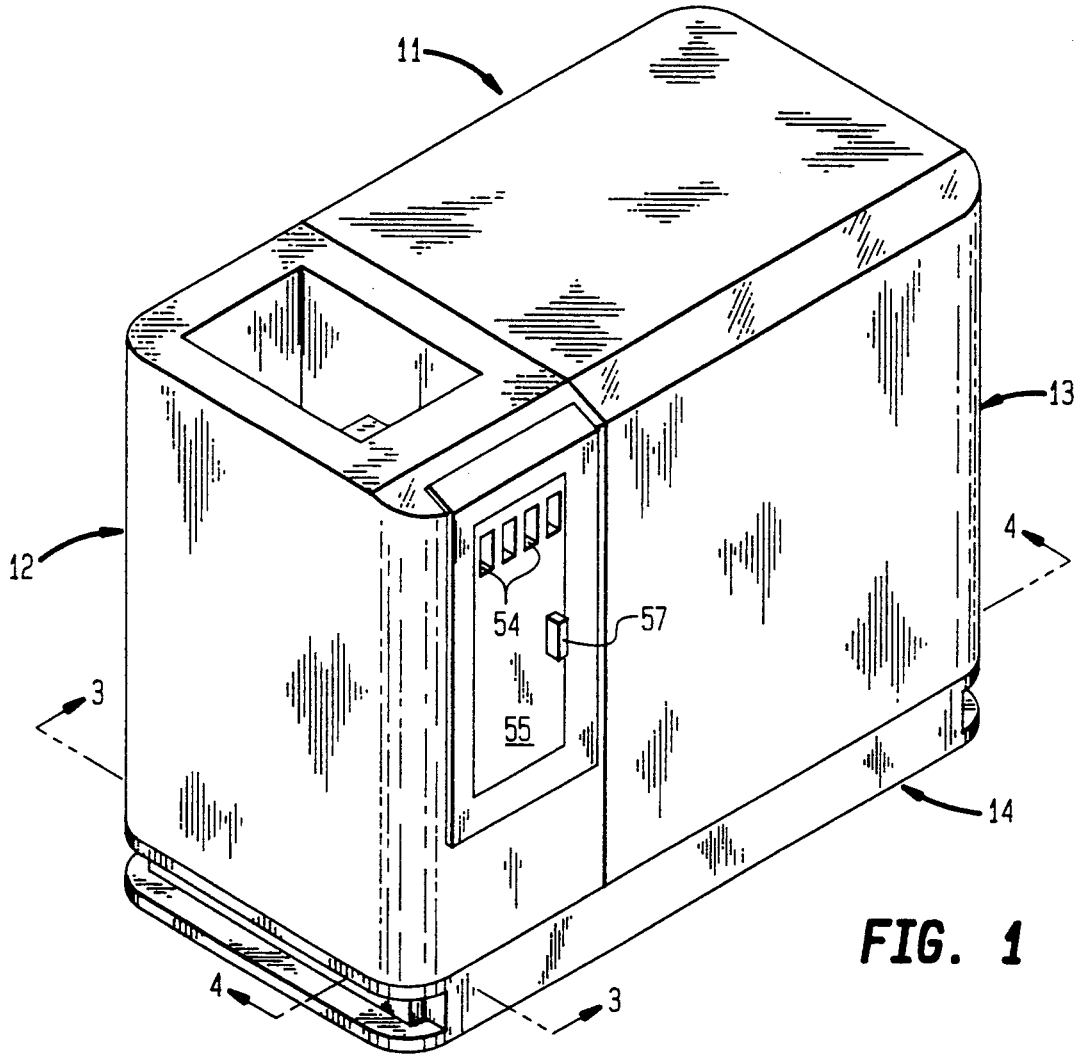
FIG. 1 is a perspective view of a humidifier in accordance with the invention.

A humidifier 11 includes an evaporation unit 12 and a liquid supply tank 13 each removably mounted side by side on a base 14. A peripheral rim portion 15 and a divider wall 16 project upwardly from an upper surface 17 of the base 14 and define an evaporator enclosure 18 for removably receiving the evaporation unit 12. Similarly a peripheral portion 19 projecting upwardly from the upper surface 17 and the divider wall 16 define a tank enclosure 21 for removably receiving the supply tank 13.

Formed in the base 14 and below the base surface 17 is a reservoir 20 that includes a boiler cavity 22 disposed within the enclosure 18. Also included in the reservoir 20 is a liquid supply channel 23 having an outlet end 24 communicating with the boiler cavity 22 and an inlet end 25 located within the tank enclosure 21. A valve actuator stem 26 projects upwardly from a bottom 27 of the liquid supply channel 23 into the inlet end 25. Pivotally mounted on the base surface 17 is a latch member 28 for securing the unit 12 to the base 14.

Figure 2:
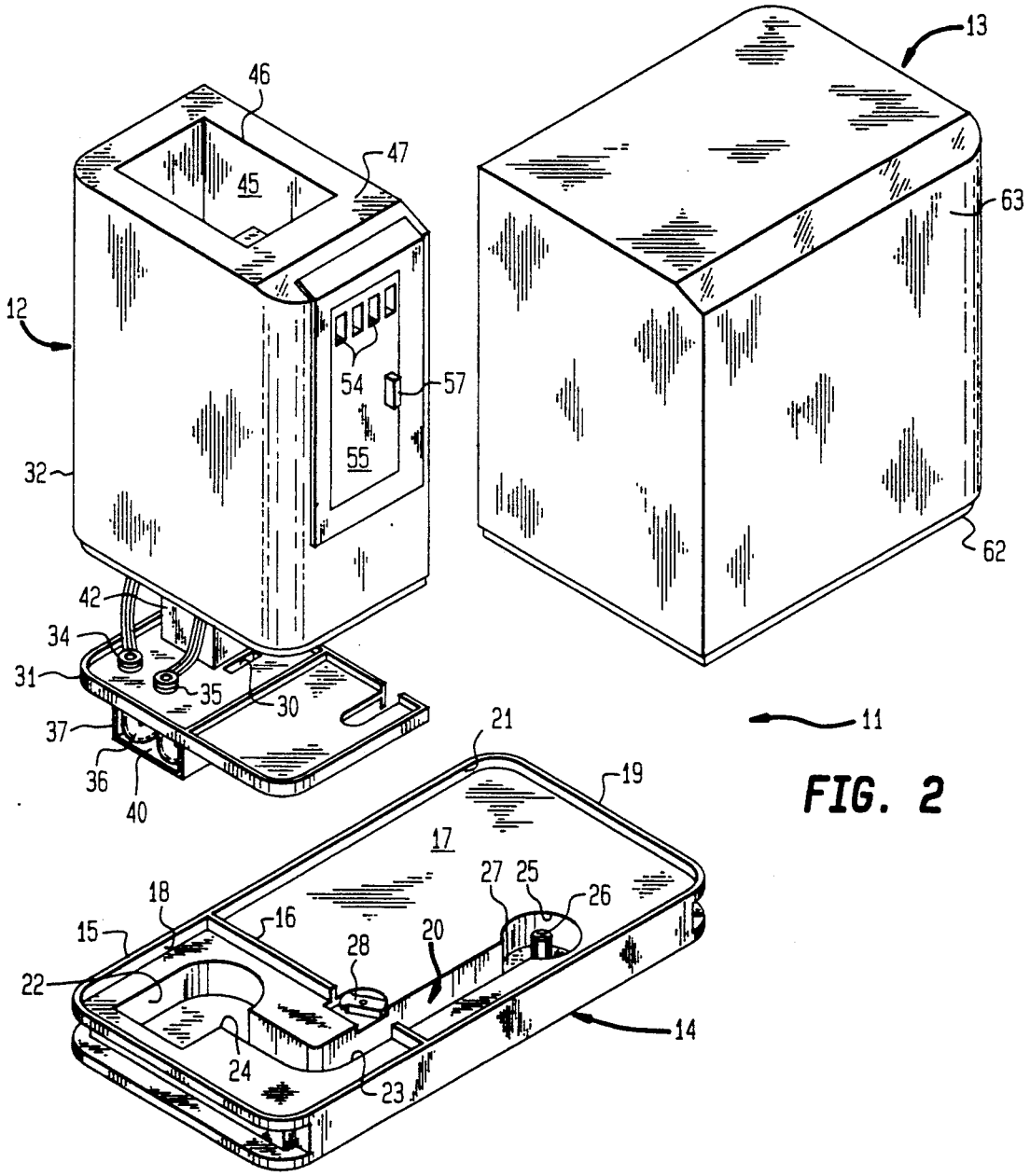
FIG. 2 is an exploded perspective view of the humidifier shown in FIG. 1.
Figure 3:
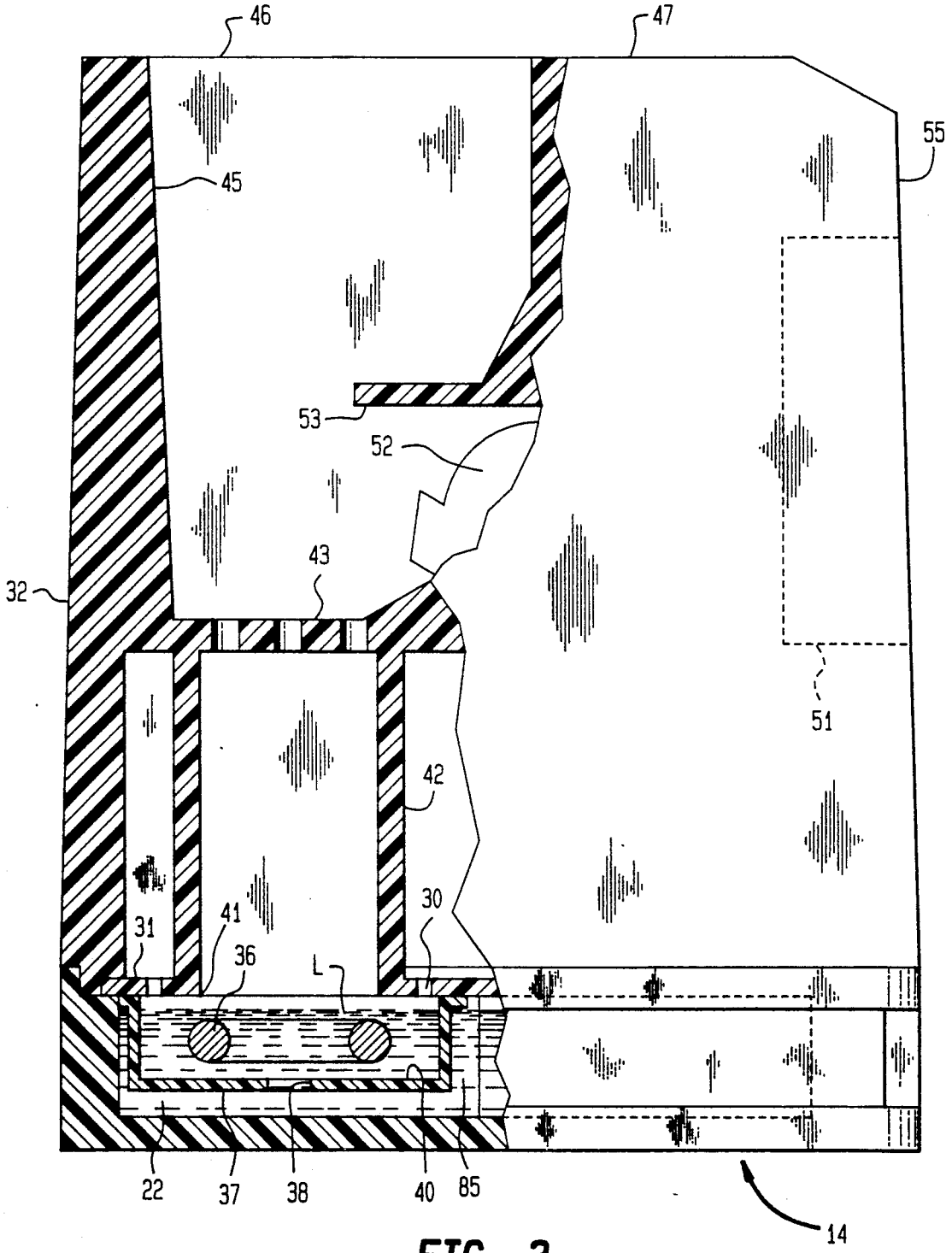
FIG. 3 is a view partially in cross section of the humidifier shown in FIG. 1.

The evaporation unit 12, as shown in FIGS. 2 and 3, includes a bottom plate 31 and an enclosure 32 supported thereby. Supported by electrical terminals 34, 35 on the bottom plate 31 and extending downwardly therefrom is an evaporator heater coil 36 that projects into the boiler cavity 22 in the base 14. An enclosure 37 provides a restricted chamber 40 surrounding the heater coil 36 and defines a liquid communication orifice 38 into the cavity 22. Extending upwardly from the bottom plate 31 over an opening 41 communicating with the enclosure 37 in the cavity 22 is a rectangular tube 42.

A slotted cover 43 closes the upper end of the tube 42. The slotted cover 43 provides fluid communication between the tube 42 and a duct portion 45 defined by the housing 32. Established by the tube 42, the slotted cover 43 and the duct portion 45 is a vapor passage with an inlet communicating via the opening 41 with the restricted chamber 40 and the cavity 22 and an outlet communicating with the surrounding environment via a discharge opening 46 in a top wall 47 of the housing 32. Retained by the housing 32 adjacent to the vapor passage duct portion 45 is electrical control circuitry 51 shown in FIG. 5. Also retained by the housing 32 is an air blower 52 with an outlet disposed to discharge air into the duct portion 45 through an air passage exit opening 53 therein. Air is supplied to the blower 52 through air passage entrance openings 54 in a front wall portion 55 of the housing 32. A control switch 57 for actuating the electrical control circuit 51 is mounted on the front wall portion 55 of the housing 32.

Figure 4:
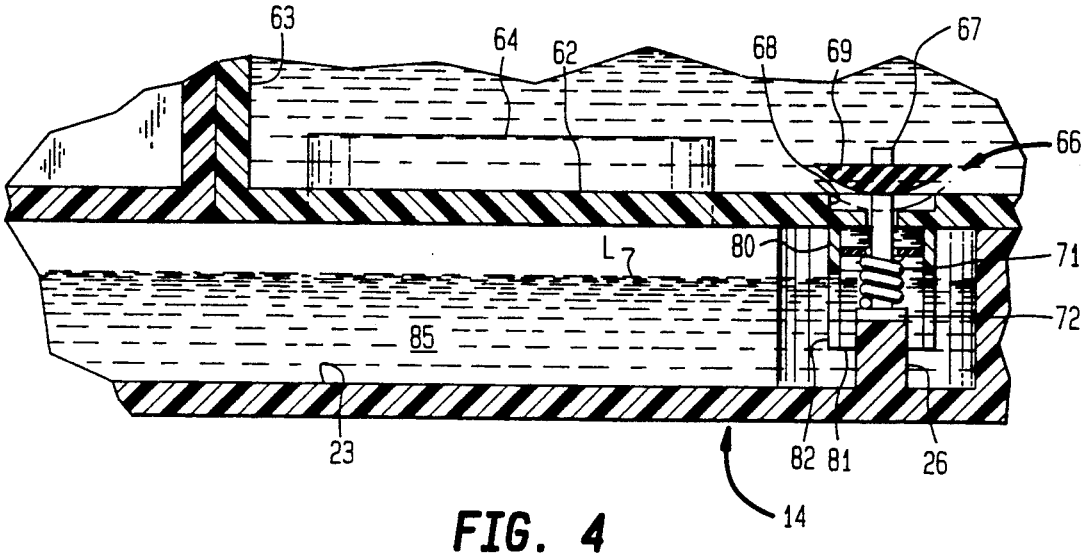
FIG. 4 is a fragmentary cross sectional view illustrating internal components of the humidifier shown in FIG. 1.

The liquid supply tank 13 includes a bottom wall portion 62 retained within the tank enclosure 21 of the base 14 and an upper portion 63 for storing a supply of liquid such as water. Closing an opening in the bottom wall portion 62 of the tank 13 is a threaded cap 64 that can be removed to fill the tank 13. A valve assembly 66 is retained by the bottom wall portion 62 of the tank 13. Forming the valve assembly 66 is a valve stem 67 extending through a discharge opening 68 in the bottom wall portion 62 and a valve 69. A spring 71 extending between the bottom wall portion 62 and a bracket 72 mounted on an end of the stem 67 normally biases the valve 69 into a seated position closing the discharge opening 68 as shown by dashed lines in FIG. 4. Projecting downwardly from the bottom wall portion 62 and enclosing a lower portion of the valve assembly 66 is a skirt 80 having an open bottom end 81 intersected by slots 82.

Figure 5:
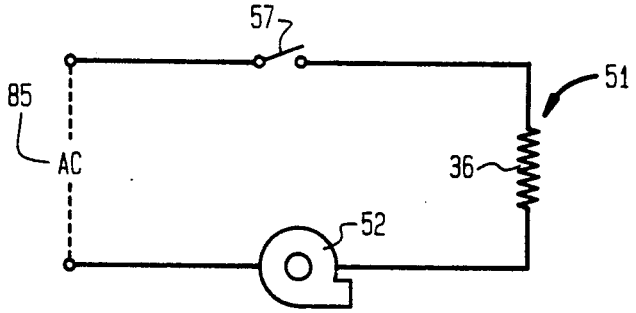
FIG. 5 is a circuit diagram of a control circuit utilized in the humidifier of FIG. 1.

As shown in FIG. 5, the control circuitry 51 includes an AC supply 85 such as a household outlet connected in series with the blower 52 and the heater coil 36 by the switch 57. In response to closing of the switch 57, electrical energy in the form of electrical current is supplied to the heater coil 36 and the blower 52.

OPERATION

To prepare the humidifier 11 for use, the tank 13 is removed from the base 14 and filled with water through an opening created by removal of the cap 64. With the cap 64 replaced and the normally seated valve 69 seated over the opening 68, the sealed tank 13 is inverted and positioned on the base 14 within the tank enclosure 21. Engagement of the bracket 72 on the valve stem 67 with the actuator stem 26 on the base 14 moves the valve 69 into an open position as shown by solid lines in FIG. 4. Accordingly, water from the tank 13 flows through the opened valve 69, the inlet end 25 and the liquid supply channel 23 into the boiler cavity 22. As long as a supply of water exists in the sealed tank 13, a water level L determined by the height of the slots 82 in the skirt 80 will be retained by the open valve 69 within the reservoir 20 formed by the boiler cavity 22 and the liquid supply channel 23.

Upon closing of the switch 57 to energize the heater coil 36, water within the restricted chamber 40 that has flowed through the orifice 38 in the enclosure 37 is heated to cause evaporation. Because of the restricted and isolated water volume provided in the boiler cavity 22 by the enclosure 37, an extremely efficient evaporation process is obtained. The vapor produced in the enclosure 37 rises through the tube 42, the slotted cover 43 and the duct portion 45 of the housing 32 for discharge through the discharge end 46 into the surrounding environment. Enhancement of the vapor discharge is obtained by energization of the blower 52 which draws air through the entrance passages 54 in the housing 32 for discharge through the exit passage 53. This air draws vapor formed in the boiler cavity 22 through the duct portion for discharge from the discharge end 46.

Obviously, many modifications and variations of the present invention are possible in light of the above teachings. It is to be understood, therefore, that the invention can be practiced otherwise than as specifically described.

What is claimed is:

1. A humidifier comprising:

a base means defining a boiler cavity;

a liquid supply means supported on said base means and having a discharge opening communicating with said boiler cavity and adapted to maintain a given level of liquid therein; and an evaporation unit mounted on said base means and substantially unattached thereto so as to facilitate complete separation therefrom so as to provide access to said cavity; said unit comprising an electrically energized resistive heating element projecting into said boiler cavity and adapted to induce evaporation of liquid contained thereby, and a vapor passage defining means having a receiving end communicating with said cavity so as to receive vapor therefrom and a discharge end for discharging the vapor received from said cavity.

2. A humidifier according to claim 1 wherein said liquid supply means is a tank means removably mounted on said base means.

3. A humidifier according to claim 1 wherein said evaporation unit further comprises air passage defining means having an entrance for receiving air from the environment and an exit communicating with said vapor passage, and blower means for inducing air flow into said entrance and out of said exit into said vapor passage.

4. A humidifier according to claim 3 wherein said liquid supply means is a tank means removably mounted on said base means.

5. A humidifier according to claim 1 wherein said base means defines reservoir means including said cavity and a liquid supply channel having an inlet end and an outlet end communicating with said cavity, and said discharge opening of said liquid supply means communicates with said inlet end of said channel so as to supply liquid therethrough to said cavity.

6. A humidifier according to claim 5 wherein said liquid supply means is a tank means removably mounted on said base means.

7. A humidifier according to claim 5 wherein said evaporation unit further comprises air passage defining means having an entrance for receiving air from the environment and an exit communicating with said vapor passage, and blower means for inducing air flow into said entrance and out of said exit into said vapor passage.

8. A humidifier according to claim 7 wherein said liquid supply means is a tank means removably mounted on said base means.

9. A humidifier according to claim 1 including an enclosure means mounted on said evaporation unit and defining a restricted chamber enclosing said heating element.

10. A humidifier according to claim 9 wherein said enclosure means further defines orifice means providing liquid communication between said cavity and said chamber.

11. A humidifier according to claim 1 including electrical supply means for supplying electrical energy to said heating element.

12. A humidifier according to claim 11 wherein said electrical supply means is retained completely in said evaporation unit.

13. A humidifier according to claim 12 wherein said base means is devoid of electrical components and electrical circuitry.

14. A humidifier according to claim 1 wherein said base means is devoid of electrical components and electrical circuitry.

15. A humidifier according to claim 1 wherein said base means is an integrally formed unitary structure.

16. A humidifier according to claim 1 including latch means securing said evaporation unit to said base.

17. A humidifier according to claim 16 wherein said latch means is a manually operated latch.

18. A humidifier comprising:

a base means defining a boiler cavity;

a liquid supply means communicating with said boiler cavity and adapted to maintain a given level of liquid therein;

an evaporation unit mounted on said base means and comprising an electrically energized heater means projecting into said cavity and adapted to induce evaporation of liquid contained thereby, and a vapor passage defining a receiving end communicating with said cavity so as to receive vapor therefrom and a discharge end for discharging the vapor received from said cavity;

electrical supply means for supplying electrical energy to said heater means; and an enclosure means defining a restricted chamber enclosing said heater means.

19. A humidifier according to claim 11 wherein said enclosure means further defines orifice means providing liquid communication between said cavity and said chamber.

20. A humidifier according to claim 12 wherein said enclosure means is supported by said evaporation unit.

21. A humidifier comprising:

a base means defining a reservoir;

a tank means supported on said base means and adapted to maintain a given liquid level in said reservoir, said tank means being substantially unattached to said base means so as to facilitate complete separation therefrom; and an evaporation unit supported on said base means adjacent to said tank means and substantially unattached to said base means so as to facilitate complete separation therefrom, said humidification unit comprising electrically energized resistive heater means projecting into said reservoir, and wherein said humidification unit and said tank means substantially cover said base means.

22. A humidifier according to claim 21 wherein said base means and said reservoir are an integrally formed one-piece unit.

23. A humidifier according to claim 18 wherein said base means is devoid of electrical components and electrical circuitry.

* * * * *